US011559105B2

(12) United States Patent
Uzzeni

(10) Patent No.: US 11,559,105 B2
(45) Date of Patent: Jan. 24, 2023

(54) ENERGIZING SAFELY SHOE

(71) Applicant: U-INVEST S.R.L., Paruzzaro (IT)

(72) Inventor: Pier Franco Uzzeni, Arona (IT)

(73) Assignee: U-INVEST S.R.L., Paruzzaro (IT)

( * ) Notice: Subject to any disclaimer, the term of this patent is extended or adjusted under 35 U.S.C. 154(b) by 105 days.

(21) Appl. No.: 16/628,071

(22) PCT Filed: Jun. 5, 2018

(86) PCT No.: PCT/IB2018/054022
§ 371 (c)(1),
(2) Date: Jan. 2, 2020

(87) PCT Pub. No.: WO2019/008453
PCT Pub. Date: Jan. 10, 2019

(65) Prior Publication Data

US 2020/0170342 A1 Jun. 4, 2020

(30) Foreign Application Priority Data

Jul. 5, 2017 (IT) ..... 102017000075302

(51) Int. Cl.
*A43B 7/32* (2006.01)
*A43B 13/18* (2006.01)

(52) U.S. Cl.
CPC ..... *A43B 13/187* (2013.01); *A43B 7/32* (2013.01); *A43B 13/188* (2013.01)

(58) Field of Classification Search
CPC ..... A43B 7/14; A43B 7/32; A43B 13/187; A43B 13/188
See application file for complete search history.

(56) References Cited

U.S. PATENT DOCUMENTS 4,404,757 A 9/1983 Sweeny
5,946,755 A 9/1999 Aoki
7,946,059 B2 5/2011 Borel
8,557,157 B2 * 10/2013 Nakano ..... B29D 35/06 264/244
8,621,765 B2 * 1/2014 Geer ..... A43B 13/10 36/12

(Continued)

FOREIGN PATENT DOCUMENTS

CA 1120710 3/1982
CN 203897427 U 10/2014

(Continued)

OTHER PUBLICATIONS

Combined Chinese Office Action and Search Report dated Jan. 7, 2021 in Chinese Patent Application No. 201880044984.X (with English translation), 14 pages.

(Continued)

*Primary Examiner* — Sharon M Prange
(74) *Attorney, Agent, or Firm* — Oblon, McClelland, Maier & Neustadt, L.L.P.

(57) ABSTRACT

An energizing safety shoe is capable of offering the user a high degree of protection in the case of accidents, in accordance with the current standards, together with a higher level of comfort perceived by the user thanks to a specific configuration of the multi-layer sole capable of respecting the ergonomics of the user in accordance with the biomechanics of walking.

10 Claims, 2 Drawing Sheets

(56) References Cited

U.S. PATENT DOCUMENTS

| | | | | |
|---|---|---|---|---|
| 2006/0283046 | A1* | 12/2006 | Mason | A43B 13/186 36/28 |
| 2014/0150298 | A1* | 6/2014 | Crowley | A43B 7/148 36/103 |
| 2016/0183631 | A1* | 6/2016 | Scofield | A43B 13/189 36/28 |
| 2016/0345668 | A1* | 12/2016 | Dyer | A43B 13/186 |
| 2017/0095033 | A1* | 4/2017 | Farina | A43B 13/143 |
| 2019/0133252 | A1* | 5/2019 | Jeong | A43B 13/181 |

FOREIGN PATENT DOCUMENTS

| | | | | | |
|---|---|---|---|---|---|
| CN | 205162087 | U | | 4/2016 | |
| DE | 297 07 398 | | * | 4/1997 | A43B 21/26 |
| DE | 297 07 398 | U1 | | 1/1998 | |
| FR | 2 583 269 | A1 | | 12/1986 | |
| RU | 2007 113 964 | A | | 10/2008 | |
| RU | 2 429 770 | C2 | | 9/2011 | |
| WO | WO 2017/089406 | A1 | | 6/2017 | |

OTHER PUBLICATIONS

Russian Office Action dated Aug. 31, 2020 in Russian Application 2019144358, filed Jun. 5, 2018 (with English translation), citing document AP therein, 7 pages.

International Search Report dated Aug. 8, 2018 in PCT/IB2018/054022 filed on Jun. 5, 2018.

Combined Chinese Office Action and Search Report dated Jul. 27, 2021 in corresponding Chinese Patent Application No. 201880044984.X (with English Translation) citing documents AO and AP therein, 16 pages.

* cited by examiner

ENERGIZING SAFELY SHOE

BACKGROUND OF THE INVENTION

Field of the Invention

The present invention refers to an energizing safety shoe.

DESCRIPTION OF THE RELATED ART

In the state of the art safety shoes, or anti-injury shoes, are known that are capable of offering the user a high degree of protection in the case of accidents.

Such shoes, in order to be able to be defined as anti-injury, must respect stringent standards.

Currently such footwear must respect standards EN ISO20344 and EN ISO20345.

As known, all safety shoes, in order to respect the current standards of the field, comprise an upper provided, at the shoe toe, with a safety toe cap sufficiently structured, and thus rigid enough, to withstand impacts and crushing, protecting the user's foot.

Since they concern work shoes, they are intended not only to be worn by the user for many hours per day consecutively, but also in activities in which the user is in continuous movement.

Hence there is a need for the safety shoes under discussion to be able to also ensure a satisfactory level of comfort for the user.

For this purpose, it is known in the state of the art to provide safety shoes equipped with a layered sole comprising an insert made of elastic material capable of making it more comfortable to rest the foot on the floor during walking.

More specifically, safety shoes are for example known in the state of the art that comprise a sole equipped with an elastic insert that extends substantially at the entirety of the user's foot sole. Such an elastic insert is provided to supply a soft and dynamic shock absorption that returns energy during walking.

Although such anti-injury shoes have been successful with users and are currently very common, they are not without drawbacks.

The drawbacks affecting anti-injury shoes known in the state of the art, and equipped with a layered sole comprising such an insert made of elastic material, include the fact that the restitution of energy ensured by the insert covers the entire sole of the foot, which does not make walking fully comfortable.

Another drawback of such anti-injury shoes consists of the fact that, in order to be able to insert an elastic insert in the sole that has a thickness such as to ensure the desired elastic restitution of walking energy, the sole itself must have a high thickness. A thick sole is, however, not very flexible and makes the shoe as a whole heavier. A thick and heavy sole makes walking less comfortable. In this way, the advantages deriving from having an elastic insert capable of returning elastic energy are at least in part zeroed by the fact that the sole is thicker, heavier and less flexible.

Another drawback of the anti-injury shoes described above consists of the fact that a thick sole compromises the appearance of the shoe as a whole.

BRIEF SUMMARY OF THE INVENTION

The main task of the present invention therefore consists of making a safety shoe that solves the aforementioned technical problem, and that avoids the drawbacks and overcomes the limitations of the prior art, making it possible to ensure the complete comfort of the user while maintaining a pleasant appearance.

In this task, a purpose of the present invention is therefore to make a safety shoe that makes walking absolutely comfortable.

A further purpose of the invention consists of making a safety shoe that is capable of ensuring the greatest guarantees of reliability and safety in use.

Another purpose of the invention consists of making a safety shoe that is easy to make and economically competitive if compared to the prior art.

The aforementioned task, as well as the stated purposes and others that will become clearer hereinafter, are accomplished by an energizing safety shoe as stated in claim 1.

Other characteristics are foreseen in the dependent claims.

BRIEF DESCRIPTION OF THE SEVERAL VIEWS OF THE DRAWINGS

Further characteristics and advantages will become clear from the description of a preferred, but not exclusive, embodiment of an energizing safety shoe according to the invention, illustrated as an example and not for limiting purposes with the help of the attached drawings, in which.

DETAILED DESCRIPTION OF THE INVENTION

Figure 1:
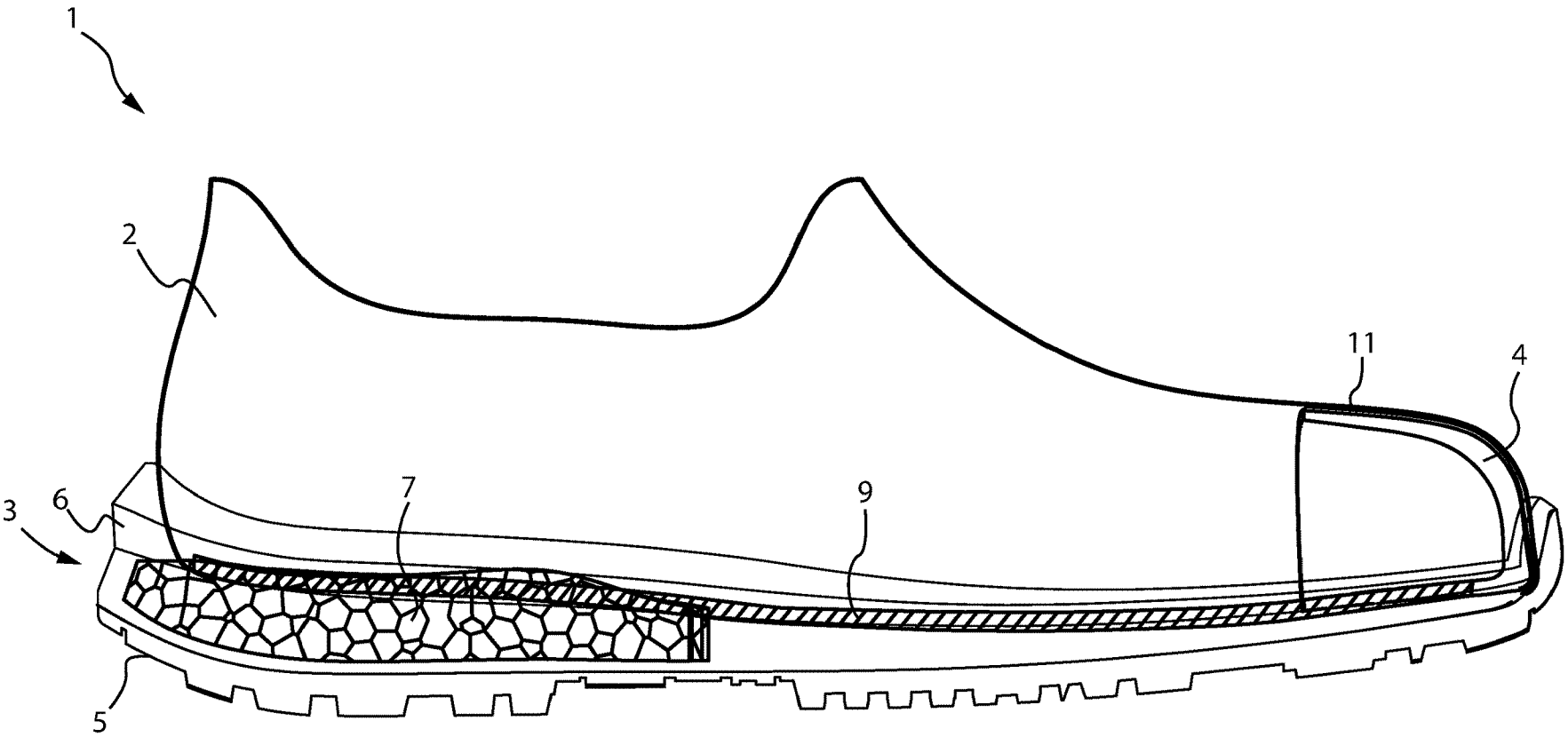
FIG. 1 is an overall side elevation view of the energizing safety shoe, according to the invention.
Figure 2:
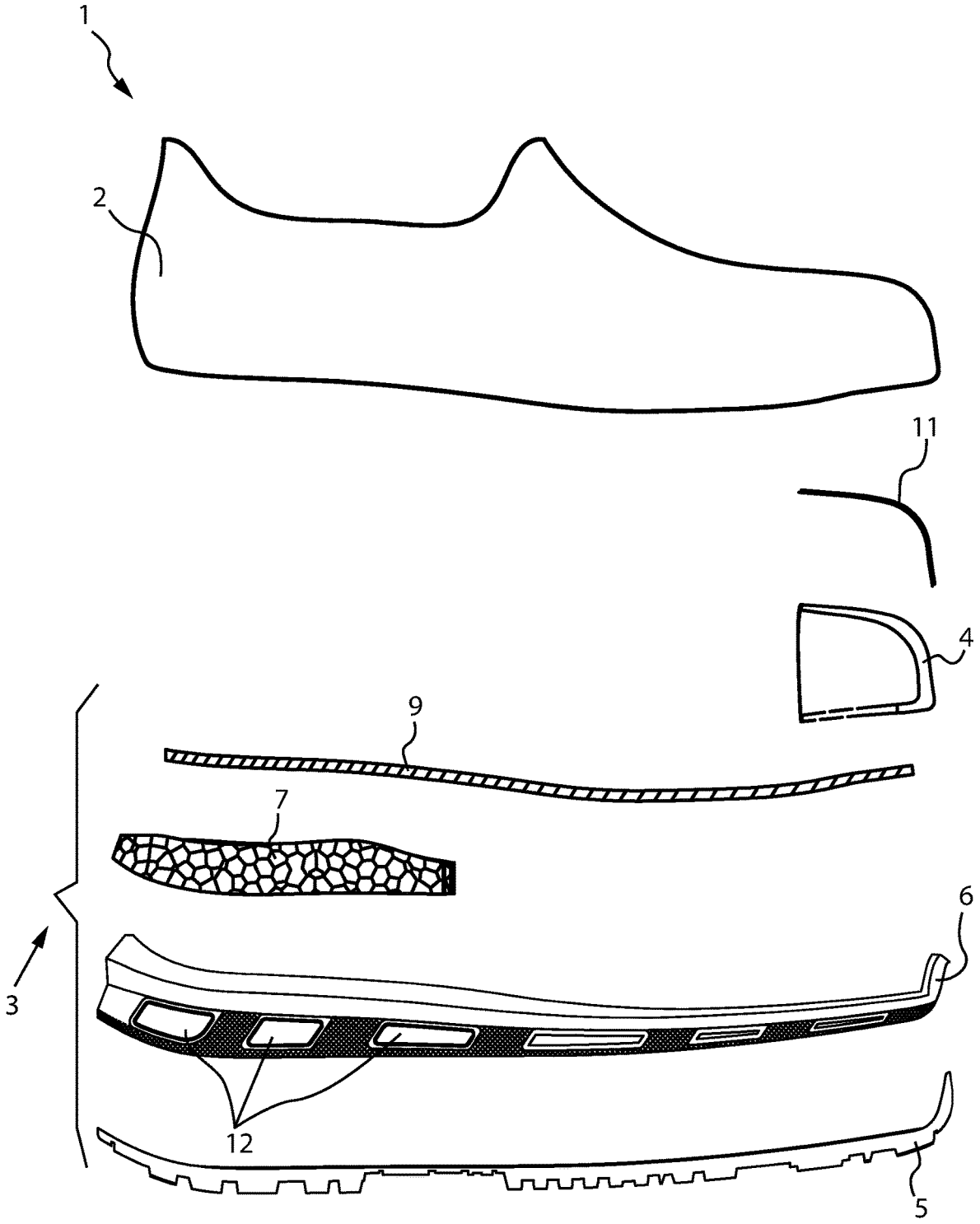
FIG. 2 is an exploded side view of the safety shoe of FIG. 1.

With reference to the quoted figures, the safety shoe according to the present invention, globally indicated with reference numeral 1, comprises an upper 2 which is equipped, at the shoe toe, with a safety toe cap 4, and a layered sole 3 associated with said upper 2. The layered sole 3 comprises a lower layer 5, adapted to come into contact with the ground, an intermediate layer 6, associated with the upper 2 and with the lower layer 5, respectively, and an upper layer 9.

According to the invention, in the intermediate layer 6 an elastic insert 7 is embedded that extends exclusively at the rear zone of the shoe 1 on a surface less than 55% of the overall surface of the layered sole 3, where the upper layer 9 thoroughly overlaps the elastic insert 7.

Basically, with the exception of the heel zone where the elastic insert 7 is present, the layered sole 3 lacks elastic inserts The elastic insert 7 is advantageously made of foamed thermoplastic polyurethane.

Preferably, the elastic insert 7 is made as a whole of foamed thermoplastic polyurethane.

Advantageously, the elastic insert 7 extends on a surface comprised between 30% and 50% of the overall surface of the layered sole 3.

In particular, the elastic insert 7 has a length equal at most to 55% of the total length of the layered sole 3 and a width slightly smaller than, if not substantially equal to, the total width of the layered sole 3. Preferably, the elastic insert 7 has a length comprised between 30% and 50% of the total length of the layered sole 3.

Advantageously, in the front zone the layered sole 3 consists exclusively of the overlapping of the lower layer 5, of the intermediate layer 6 and of the upper layer 9.

Basically, in the front zone of the shoe 1, the layered sole 3 is advantageously devoid of any type of insert.

Advantageously, the maximum thickness of the elastic insert 7 is less than 21 millimetres.

The maximum thickness of the insert 7 is indeed advantageously comprised between 18 and 21 millimetres depending on the dimensions of the energizing shoe 1, and thus depending on the size thereof. For example, for shoes 1 sized between 35 and 37 French points the maximum thickness of the insert 7 is about 18 millimetres, whereas for shoes 1 sized between 45 and 48 French points, the maximum thickness of the insert is about 21 millimetres.

Advantageously, the layered sole 3 has, at the front zone, a thickness substantially smaller than the thickness of the layered sole 3 at the rear zone.

In this way, a slight difference in level is created between the heel and forefoot of the user, which makes the shoe 1 more comfortable, in particular during walking.

Moreover, the fact that the thickness of the layered sole 3 at the front zone of the shoe 1 is less than the thickness in the rear zone makes the shoe 1 more streamlined, making it more aesthetically pleasing.

Advantageously, the thickness of the layered sole 3 at the front zone of the shoe 1 is equal at most to 65% of the thickness of the layered sole 3 at the rear zone of the shoe 1.

Advantageously, the maximum thickness of the layered sole 3 is less than 55 millimetres.

Such a maximum thickness of 55 millimetres of the layered sole 3 is reached in the rear zone of the shoe 1, at the user's heel.

The maximum thickness of the layered sole 3 at the front zone of the shoe 1, i.e. at the forefoot of the user, is on the other hand less than 35 millimetres.

The lower layer 5 is preferably made of polyurethane or nitrile material, or a combination of these two elements.

The intermediate layer 6 is also preferably made of polyurethane material.

According to a preferred embodiment of the energizing safety shoe according to the present invention, the upper layer 9 that covers said elastic insert 7, preferably comprises an anti-puncture sheet.

Advantageously, said anti-puncture sheet extends so as to thoroughly cover and protect the user's foot sole when the shoe is worn.

Said anti-puncture sheet is preferably made of non-metallic material, for example polyester resin-based material or similar material.

The upper layer 9 can be defined by the same material of which the intermediate layer 6 is made. In this way, the elastic insert 7 is completely embedded in the material of which the intermediate layer 6 and the upper layer 9 are made, with the exception of the portions that face the windows 12. The energizing safety shoe according to the present invention comprises a safety toe cap 4 in the front zone of the upper 2 that satisfies the current safety standards, including EN ISO20344 and EN ISO20345.

Although the minimum requirement for meeting the requirements established by the standards is the simple presence of a safety toe cap 4, advantageously the shoe 1 according to the present invention is equipped with a safety toe cap 4 equipped with holes configured to ensure the transpiration of the foot, according to a solution developed by the Applicant.

Preferably, moreover, a protective membrane 11 is provided to close the holes made on the toe cap 4, so as to allow at the same time the transpiration and the protection of the user's foot.

According to a preferred embodiment of the shoe, one or more windows 12 can be provided on the side surfaces of the intermediate layer 6 in order to make the elastic insert 7 arranged inside the intermediate layer 6 itself visible, however at the same time they also perform the technical function of allowing the outward deformation of the elastic material in which such an elastic insert 7 is made, so as to assist the deformation of the material after compression, increasing the ability to deform, elastically absorbing the forces deriving from the weight of the user during the act of walking.

It has thus been seen how the energizing safety shoe as described up to here object of the present invention makes it possible to perform the task and to obtain the purposes for which it was devised.

In particular, the energizing safety shoe object of the present invention is comfortable to wear, easy to use and aesthetically pleasing.

The energizing safety shoe object of the present invention, thanks to the fact that it has a thinner sole, is overall more aesthetically pleasing, streamlined and lighter, to the point of aesthetically looking more like a sports shoe than a safety shoe.

It should be understood that the embodiment described as an example can undergo numerous modifications and variants, all of which are covered by the invention; moreover, all of the details can be replaced by technically equivalent elements.

In particular, the materials used, as well as the sizes, can be whatever according to the technical requirements.

The invention claimed is:

1. An energizing safety shoe, comprising:

an upper, provided, at a shoe toe, with a safety toe cap and a layered sole associated with said upper, said layered sole comprising a lower layer adapted to come into contact with a ground;

an intermediate layer associated with said upper and said lower layer, respectively; and an upper layer, wherein in said intermediate layer, an elastic insert is embedded, which extends exclusively at a rear zone of said shoe on a surface less than 55% of an overall surface of said layered sole, in a front zone of said shoe extending from the elastic insert to the shoe toe, said layered sole being devoid of any type of insert, wherein said upper layer comprises an anti-puncture sheet made of a polyester-resin based material which extends so as to thoroughly cover and protect a foot sole of a user, said upper layer being thoroughly overlapped on said elastic insert, and wherein a plurality of windows are provided on side surfaces of said intermediate layer in order to make visible said elastic insert placed inside said intermediate layer, said plurality of windows being suitable for allowing an outward deformation of an elastic material in which said elastic insert is made.

2. The energizing safety shoe according to claim 1, wherein in the front zone of said shoe said layered sole is formed exclusively by overlapping of said lower layer, said intermediate layer and said upper layer.

3. The energizing safety shoe according to claim 1, wherein a maximum thickness of said elastic insert is less than 21 millimeters.

4. The energizing safety shoe according to claim 1, wherein at the front zone of said shoe said layered sole exhibits a thickness substantially thinner than a thickness of said layered sole at said rear zone.

5. The energizing safety shoe according to claim 1, wherein a thickness of said layered sole, at the front zone of said shoe, is equal, at most, to 65% of a thickness of said layered sole at said rear zone of said shoe.

6. The energizing safety shoe according to claim 1, wherein a maximum thickness of said layered sole is less than 55 millimeters.

7. The energizing safety shoe according to claim 1, wherein a maximum thickness of said layered sole at the front zone of said shoe is less than 35 millimeters.

8. The energizing safety shoe according to claim 1, wherein said upper layer is defined by a same material from which said intermediate layer is made, said elastic insert being completely embedded in said material from which said intermediate layer and said upper layer are made.

9. The energizing safety shoe according to claim 1, wherein said elastic insert extends over a surface comprised between 30% and 50% of the overall surface of said layered sole.

10. The energizing safety shoe according to claim 1, wherein said elastic insert is made as a whole of foamed thermoplastic polyurethane.

* * * * *